US012745833B1

(12) United States Patent
Zheng

(10) Patent No.: US 12,745,833 B1
(45) Date of Patent: Sep. 29, 2026

(54) ANTI-ROLLOVER HAMMOCK

(71) Applicant: Qinwen Zheng, Guangdong (CN)

(72) Inventor: Qinwen Zheng, Guangdong (CN)

( * ) Notice: Subject to any disclaimer, the term of this patent is extended or adjusted under 35 U.S.C. 154(b) by 0 days.

(21) Appl. No.: 19/403,432

(22) Filed: Nov. 28, 2025

(51) Int. Cl.
*A45F 3/22* (2006.01)

(52) U.S. Cl.
CPC ..... *A45F 3/22* (2013.01)

(58) Field of Classification Search
CPC ..... A45F 3/52; A45F 3/24; A45F 3/22; E04H 15/00
USPC ..... 5/121
See application file for complete search history.

(56) References Cited

U.S. PATENT DOCUMENTS 1,183,485 A * 5/1916 Palmer ..... A45F 3/22 5/121
1,401,846 A * 12/1921 Wiles ..... A45F 3/22 5/121
4,001,902 A * 1/1977 Hall ..... A45F 3/22 5/121
12,082,682 B1 * 9/2024 Zheng ..... A45F 3/52

FOREIGN PATENT DOCUMENTS

CN 109349776 A * 2/2019 ..... A45F 3/22
DE 202021001622 U1 * 6/2021 ..... A45F 3/22
WO WO-0204767 A1 * 1/2002 ..... A45F 3/24

* cited by examiner

*Primary Examiner* — Eric J Kurilla
(74) *Attorney, Agent, or Firm* — Hawaii Patent Services; Nathaniel K. Fedde; Kenton N. Fedde

(57) ABSTRACT

The present disclosure relates to an anti-rollover hammock, comprising a hammock body, a suspension structure, and an extension part disposed below the hammock body. The edge of the extension part extends upward and is connected with the side edge of the hammock body, collectively forming an upward pocket-shaped supporting structure. When a user lies down, this structure effectively supports the body and confines center-of-gravity shifts within its space, fundamentally eliminating rollover risks.

20 Claims, 6 Drawing Sheets

ANTI-ROLLOVER HAMMOCK

TECHNICAL FIELD

The present disclosure relates to the technical field of outdoor hammocks, particularly to an anti-rollover hammock.

BACKGROUND

As a sport and leisure activity that embraces nature and is environmentally friendly, outdoor sports are attracting increasing attention and have become a hobby for more and more people. Hammocks are also increasingly becoming part of travel gear, serving as an essential item for camping and outdoor activities.

Traditional hammocks mostly adopt a structural form of "fixed at two ends with a flexible bottom." For example, U.S. patent application Ser. No. 18/379,663 discloses a stable flat-laying hammock and its usage method, which requires tying both ends of the hammock to fixed points such as trees or supports during use and relies on flexible materials like canvas or nylon at the bottom to bear the user's weight.

However, such structures still have obvious limitations in practical use. When lying down, the user's weight causes the flexible bottom to naturally form an arc-shaped state with a low middle and high sides. Any movement, such as turning over or adjusting posture, can easily shift the body's center of gravity to one side. The lack of rigid support in the bottom fabric makes it unable to provide stable bearing, often leading to the entire hammock rolling over. This not only interrupts rest but may also cause the user to bump and get injured. Additionally, the risk of rollover limits usage scenarios, such as making it difficult to read or use electronic devices comfortably in the hammock. Safety is even harder to ensure for groups like the elderly or children, significantly reducing overall convenience and user experience.

SUMMARY

The present disclosure provides an anti-rollover hammock to address the issues raised in the background art.

To achieve the above object, the present disclosure adopts the following technical solutions:

An anti-rollover hammock includes: a hammock body for supporting a user; a suspension structure mounted at two ends of the hammock body and configured to be connected with an external support object; and a center-of-gravity stabilizing structure connected to the hammock body and collectively forming a stable area capable of accommodating at least part of the user's body. The center-of-gravity stabilizing structure is adapted to guide and constrain center-of-gravity shifts caused by rolling or posture changes when a force is applied by the user, keeping a center of gravity of the user within a stable range of a main structure to reduce or prevent lateral rollover of the hammock in a suspended state.

The present disclosure provides another technical solution: an anti-rollover hammock, including a hammock body for supporting a user; a suspension structure mounted at two ends of the hammock body and configured to be connected with an external support object; and an extension part connected to the hammock body, with an edge thereof extending upward and connecting to a side edge of the hammock body, collectively forming an upward pocket-shaped supporting structure. When the user lies down, the pocket-shaped supporting structure is adapted to support the user's body and confine center-of-gravity shifts caused by body movements within a space formed by the pocket-shaped supporting structure to prevent the hammock from rolling over.

The beneficial effects of the present disclosure compared to prior art are as follows:

The present disclosure features a pouch-like extension part beneath the hammock body. When the user lies down, their weight is supported by this extension part, effectively confining and stabilizing the center of gravity at the hammock's center, fundamentally eliminating rollover risks. Additionally, by adding support rods at key stress points to distribute force and optionally equipping an air cushion for enhanced comfort and insulation, the present disclosure achieves a hammock that is safe, stable, comfortable, durable, and suitable for broader usage scenarios.

BRIEF DESCRIPTION OF DRAWINGS

The drawings included in this application provide further understanding of the present disclosure. The illustrative embodiments and descriptions therein explain the present disclosure and do not constitute undue limitations. In the drawings.

Figure 1:
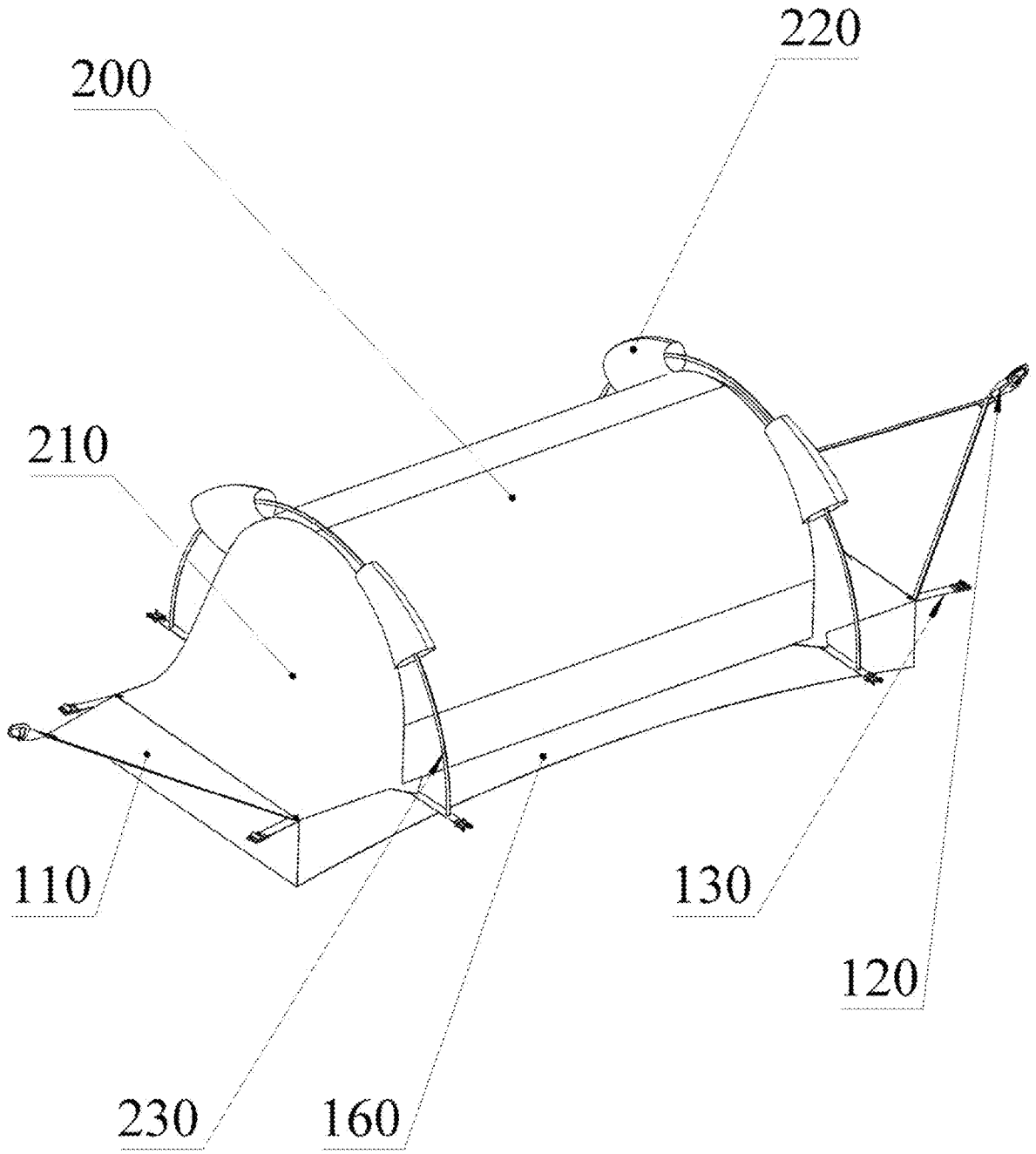
FIG. 1 is a perspective schematic view of an embodiment provided by the present disclosure.

Reference signs: Hammock Body (100); Connecting Part (110); Connecting Buckle (120); Adjusting Buckle (130); Connecting Cap (131); Connecting Tube (140); Support Rod (150); Extension Part (160); Mounting Part (170); Fixing Hole (171); Air Cushion (180); Insect-Proof Net (200); Fixing Part (210); Supporting Part (220); Arc-Shaped Rod (230); Fixing Head (231); Center-Of-Gravity Stress Point (M).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, equipment, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

Figure 5:
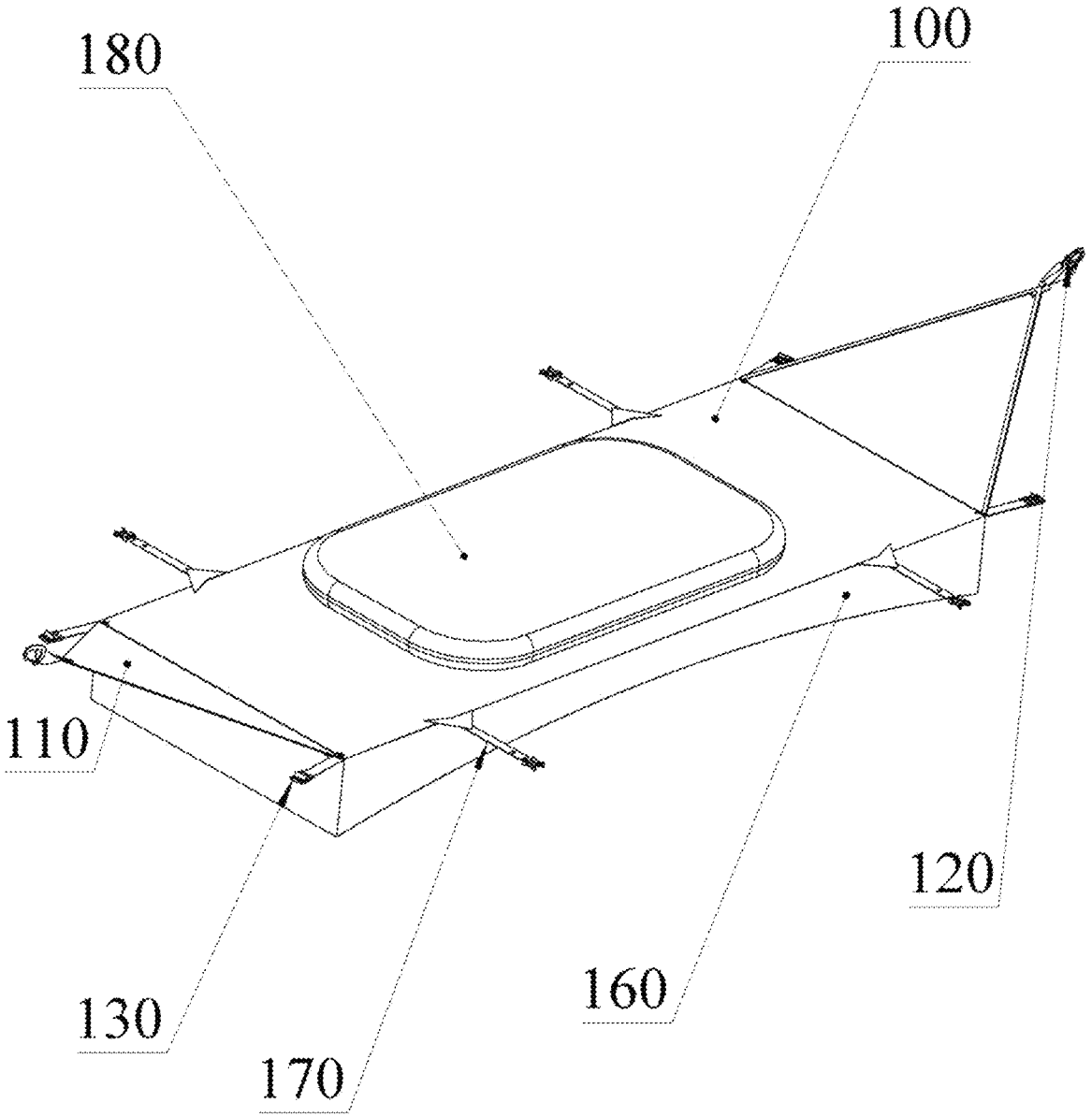
FIG. 5 is a structural schematic view of the hammock body in the embodiment shown in FIG. 1.

Please refer to FIGS. 1 and 5. The present disclosure provides an anti-rollover hammock, which includes a hammock body 100 with connecting parts 110 at two ends. Two connecting buckles 120 are fixedly installed at the ends of the connecting parts 110 away from the hammock body.

Here, the transverse width of the connecting part 110 decreases in the direction away from the hammock body, and it has an overall triangular cross-section. Meanwhile, the connecting part 110 is made of flexible material.

It should be noted that the hammock body 100 is formed from a single layer of flexible material, which can provide users with a comfortable sleeping experience. In other embodiments (not shown), the hammock body is not limited to a single layer of sturdy flexible material. An additional layer of softer, more comfortable flexible material can be added to the single-layer sturdy flexible material to enhance user comfort. Alternatively, a layer of more breathable flexible material can be added for a cooler experience, suitable for hot environments, or a layer of better-insulating flexible material can be added for a warmer experience, suitable for cold environments. Any number of layers or flexible materials with desired properties can be incorporated into the hammock body.

Since the joint between the connecting part 110 and the hammock body 100 is the main stress point, prolonged use or excessive weight can cause the stitching or fabric at this location to tear due to stress concentration. To fundamentally address this issue, in a preferred embodiment of the present disclosure, a reinforcing patch is added at the joint between the connecting part 110 and the hammock body 100.

The reinforcing patch is made of high-strength flexible material, such as high-density nylon, Oxford cloth, or canvas, and is preferably shaped as a triangle or trapezoid. One side (e.g., the base of the triangle) of the reinforcing patch is fixed to the end of the hammock body 100 via stitching, adhesion, or integrated molding. The other side (e.g., the leg of the triangle) is fixed to the proximal end of the connecting part 110 in the same manner.

In other embodiments, referring to FIGS. 1 and 5, adjusting buckles 130 are fixedly installed on both sides below the connecting part 110 at each end of the hammock body 100.

Both the connecting buckle 120 and the adjusting buckle 130 can be attached to connecting ropes, which can be tied to external objects (e.g., tree trunks) to secure the connecting part 110 and the hammock body 100 between two external objects.

It should be noted that the connecting rope attached to the connecting buckle 120 has a first fixing point for securing to an external object, while the connecting rope attached to the adjusting buckle 130 has a second fixing point for securing to an external object. The first fixing point is positioned higher on the external object than the second fixing point. When all three connecting ropes are tied, the ropes attached to the connecting buckle 120 and the adjusting buckle 130 form an approximate triangular structure, ensuring the hammock body 100 maintains a flat, non-sagging surface.

In this embodiment, the connecting buckle 120 consists of a connecting strap and a snap buckle, which can be connected to the connecting rope; the adjusting buckle 130 consists of a connecting strap and a horseshoe buckle. By incorporating the horseshoe buckle, the tightness of the connecting rope can be adjusted.

Figure 4:
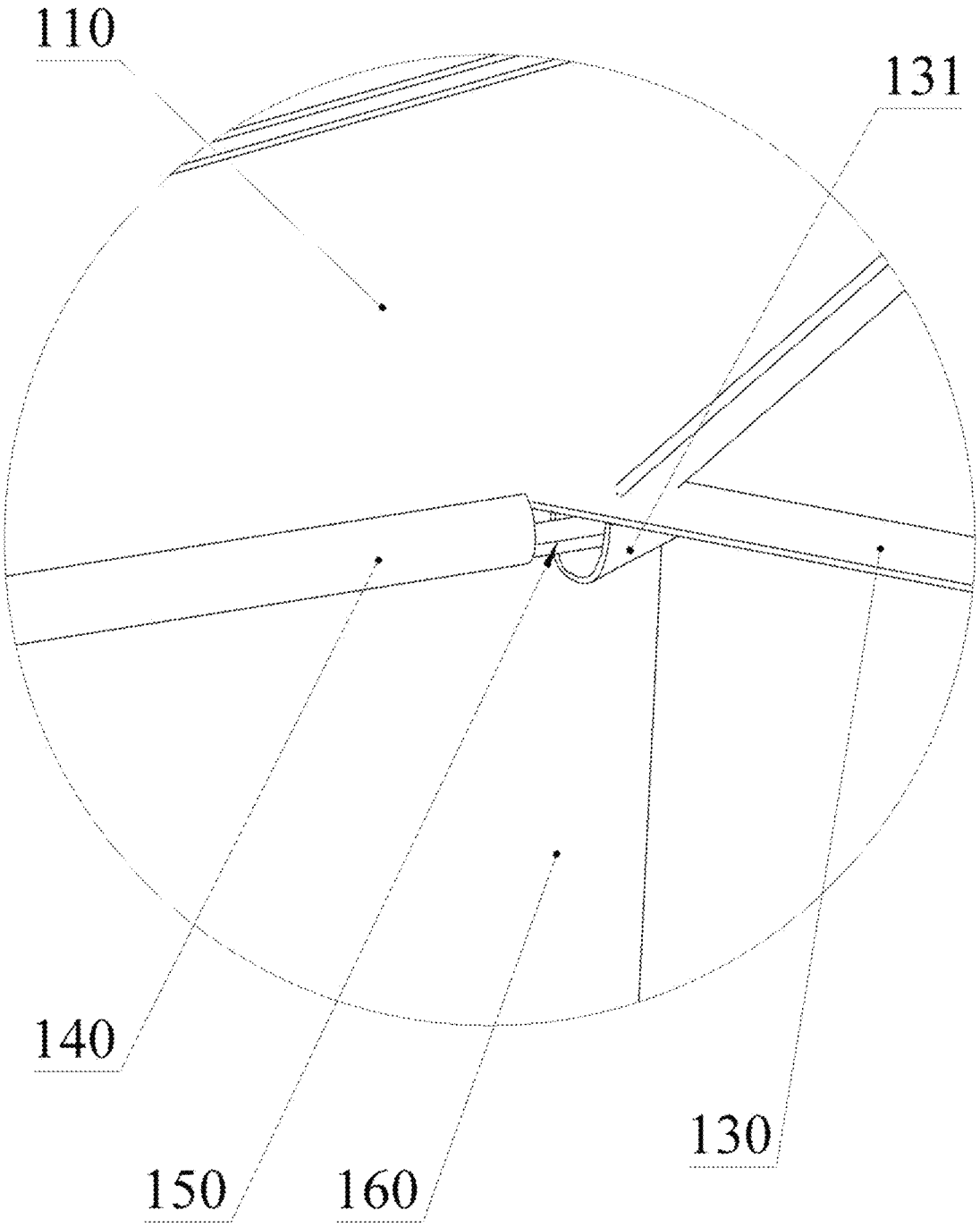
FIG. 4 is an enlarged schematic view of section B in the embodiment shown in FIG. 2.

Please refer to FIGS. 1 and 4. To ensure the connecting part 110 has sufficient strength when tied to an external object, this embodiment adds a connecting tube 140 at the joint between the connecting part 110 and the hammock body 100. The connecting tube 140 is open at two ends and arranged parallel to the joint, with a support rod 150 inserted inside. Through the cooperation of the connecting tube 140 and the support rod 150, the concentrated stress on the connecting part 110 is effectively dispersed from a line to a surface. This fundamentally avoids stress concentration. Meanwhile, the support rod 150 can laterally support both ends of the hammock body 100, expanding the usable space at the bottom and effectively preventing the user from being constrained or pinched by narrow spaces while lying down. Additionally, the rigid support surface formed by the support rod 150 resists torsional tendencies caused by body shifts, enhancing the anti-tipping stability of the overall structure.

In this embodiment, the support rod 150 is a single integral rod. In other technical solutions, the support rod 150 can be designed as two combinable rods connected by an elastic element. This design saves space when storing the support rod 150, and the elastic element prevents the loss of one rod while facilitating the assembly of the support rod 150. Alternatively, the telescopic rod can also be configured with three, four, five, or any other desired number of rods.

In other embodiments (not shown), the connecting tube 140 is not limited to being made of sturdy flexible material but can also be formed from plastic, silicone, or any other desired material. In this embodiment, the connecting tube 140 is sewn to the hammock body 100. In some embodiments, the connection method can also be integrally molded, hook-and-loop, adhesive bonding, snap fastening, or any other desired connection method.

In another embodiment, to further enhance structural integrity and stability, please refer to FIGS. 1 and 4. Connecting caps 131 are fixed on the sides of the two adjusting buckles 130 facing the connecting tube 140. These two connecting caps 131 are sleeved over the two ends of the support rod 150, respectively. When the connecting part 110 is fully assembled, the connecting caps 131 provide effective axial restraint to the support rod 150, preventing it from shifting or slipping during use. This ensures the support rod 150 remains in the optimal working position, making the force transmission more direct and reliable.

Please refer to FIGS. 1 and 5. In this embodiment, an extension part 160 is provided below the hammock body 100 and connected to it. This extension part 160 is made of high-strength flexible material, with its edges turned upward and connected to the side edge of the hammock body 100, forming an integrated structure resembling a hammock-within-a-hammock or a pouch-like design.

Figure 6:
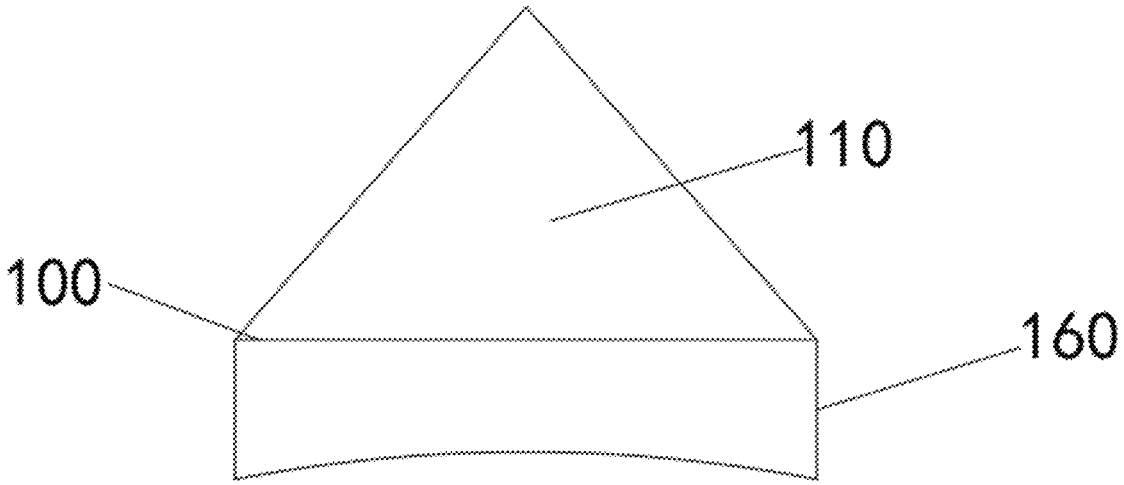
FIG. 6 is a schematic view of the hammock body in an unloaded state in the embodiment provided by the present disclosure.
Figure 7:
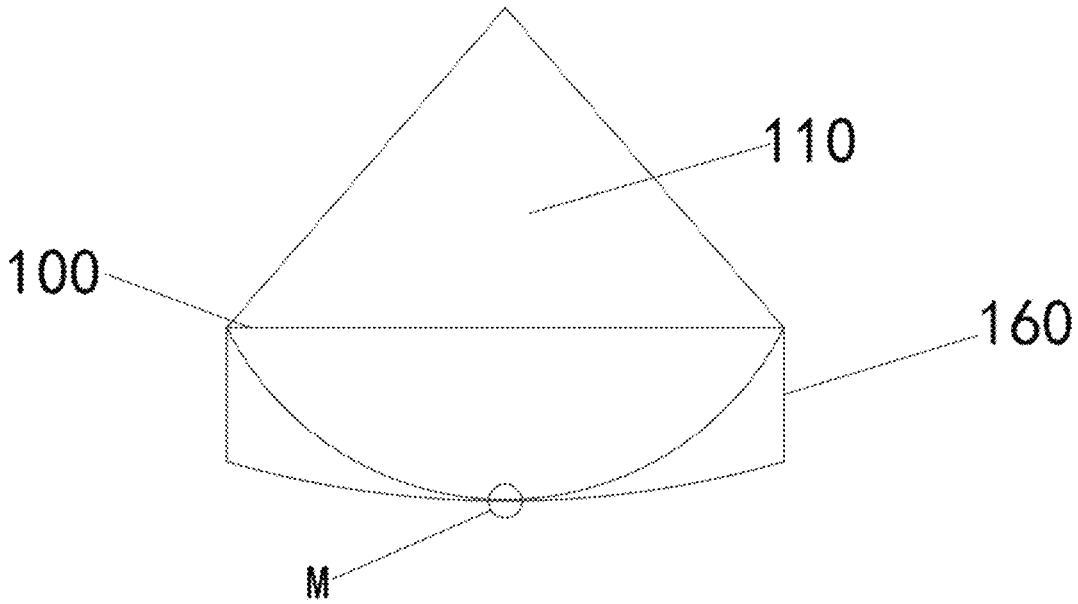
FIG. 7 is a schematic view of the hammock body in a loaded state in the embodiment provided by the present disclosure.

Please refer to FIGS. 6 and 7. When the user lies on the hammock body 100, their body weight causes the hammock body 100 to naturally sag downward. At this point, the primary load-bearing component shifts from the traditional bottom fabric of the hammock to the more enveloping extension part 160. Through this structure, the user's overall center of gravity is effectively confined and stabilized within the pouch-like space formed by the extension part 160, rather than directly acting on the connecting parts 110 on both sides. Thus, no matter how the user tosses or changes positions during sleep, their center-of-gravity shift is effectively restrained and compensated for by the extension part 160, fundamentally preventing the hammock from tipping over.

Meanwhile, traditional hammocks naturally form a banana-like arc when hung due to fixed ends and a flexible middle. When lying in it, the user is forced to curl up in this arc, with the spine in an unnatural bent position, making comfortable flat lying impossible. Prolonged use can easily cause back discomfort. In this embodiment, the bottom of the extension part 160 is designed with a transverse arc. When the user lies down and their body weight presses downward, this preset transverse arc is stretched and flattened, creating a relatively level support area beneath the body. This effectively counteracts the banana effect of traditional hammocks, allowing the user's spine to remain closer to the straight posture of natural sleep, significantly improving lying comfort and enabling flat lying on the hammock.

In this embodiment, the extension part 160 and the hammock body 100 are joined using high-strength nylon threads with double or triple rows of lock stitching, forming a permanent, integrated load-bearing interface. The stitching path precisely follows the side edge structure of the hammock body 100 and the upturned edge of the extension part 160, ensuring tight overlap and creating a seamless, joint-free flexible structure. In some embodiments, the connection method can also be set as integral molding, hook-and-loop fasteners, adhesive bonding, snap buttons, or any other desired connection method.

On the basis of the above embodiments explaining the basic structure of the present disclosure and its anti-rollover principle, to further enrich the technical solutions of the present disclosure and adapt it to more usage scenarios, the present disclosure also provides various other optional implementations. The following embodiments are all based on the same technical concept of the present disclosure. Through different designs of the hammock body structure, support form, or center-of-gravity stabilization mechanism, effective control of the user's center of gravity is achieved under different structural conditions, thereby further enhancing the overall stability of the hammock in a suspended state. Specific solutions are as follows:

In other embodiments (not shown), the hammock body 100 is made of flexible or semi-flexible materials through an integrated molding process. Its central area is pre-designed as a downwardly concave trough shape, with naturally raised sidewall structures formed on both sides of the trough-shaped main body, thereby creating a three-dimensional support space that accommodates the user's body. During use, when the user lies flat or turns over, the main weight of the body automatically falls into the trough-shaped space, stabilizing the user's center of gravity in the central area of the hammock and reducing lateral rollover caused by center-of-gravity shifts. This embodiment does not require a separate extension part structure and can be completed through integrated processing methods such as heat pressing, molding, or molded weaving.

In other embodiments (not shown), both sides of the hammock body 100 extend to form flexible side wings. The wings naturally hang down when unloaded. When the user lies on the hammock, the wings fold inward under the combined effect of the user's body and the hammock's deformation, forming an enveloping support space together with the hammock body 100.

When the user turns over or shifts to one side, the corresponding wing generates greater pulling force, guiding the user's body back to the central area of the hammock, thereby reducing the risk of rollover.

The wings can be made of elastic materials, mesh materials, or multi-layer composite materials to meet different usage needs.

In other embodiments (not shown), the hammock body 100 is designed as a dual-layer flexible support structure, with a deformable suspension chamber formed between the two layers. The upper layer supports the user's body, while the lower layer provides positional compensation when the user leans to one side.

When the user shifts to one side, the lower-layer structure on that side deforms under the user's weight and generates a restoring force to guide the user's center of gravity back to the central area, thereby achieving anti-rollover effect. This structure can be realized using double-layer fabric, elastic mesh layers, or flexible support layers.

In other embodiments (not shown), multiple airbags are arranged below the hammock body 100 and connected through air channels or one-way valves to form an integrated pneumatic cushioning system.

When the user leans to one side, the airbag on the offset side is compressed under force, and the internal gas is pushed to the opposite side airbag, causing partial expansion of the opposite side airbag. This applies a corrective torque to the user's body, achieving anti-rollover functionality. The airbags can be detachable for easy storage and cleaning, or built-in for enhanced durability.

In other embodiments (not shown), the hammock body 100 is embedded with several semi-rigid support sheets distributed along its width, maintaining a downward-curved surface when unloaded.

When the user lies down and shifts, the support sheets provide stable shape retention, allowing the user's center of gravity to slide back to the central area of the hammock, reducing rollover risk.

The support sheet material may include polypropylene sheets, fiberglass boards, carbon fiber laminates, etc.

In other embodiments (not shown), lightweight curved frames are installed on both sides of the hammock body 100, connected to the fabric via fasteners or sockets, giving the hammock a basket-like shape.

The curved frames keep the hammock's sides raised and the middle naturally sunken during use, forming a stable support zone. When the user shifts, the frames resist lateral tilting, maintaining the center of gravity in the central area.

The frame material may be lightweight options like carbon fiber, fiberglass, or aluminum alloy.

In other embodiments (not shown), several guide straps are arranged below the hammock body 100 along its length or width, with both ends connected to each side of the hammock.

When the user shifts, the offset-side guide strap experiences greater tensile displacement, while the opposite strap generates a counter-pull force, automatically balancing the user's center of gravity and returning the body to the central area.

The guide straps may be made of high-strength or elastic webbing.

Figure 2:
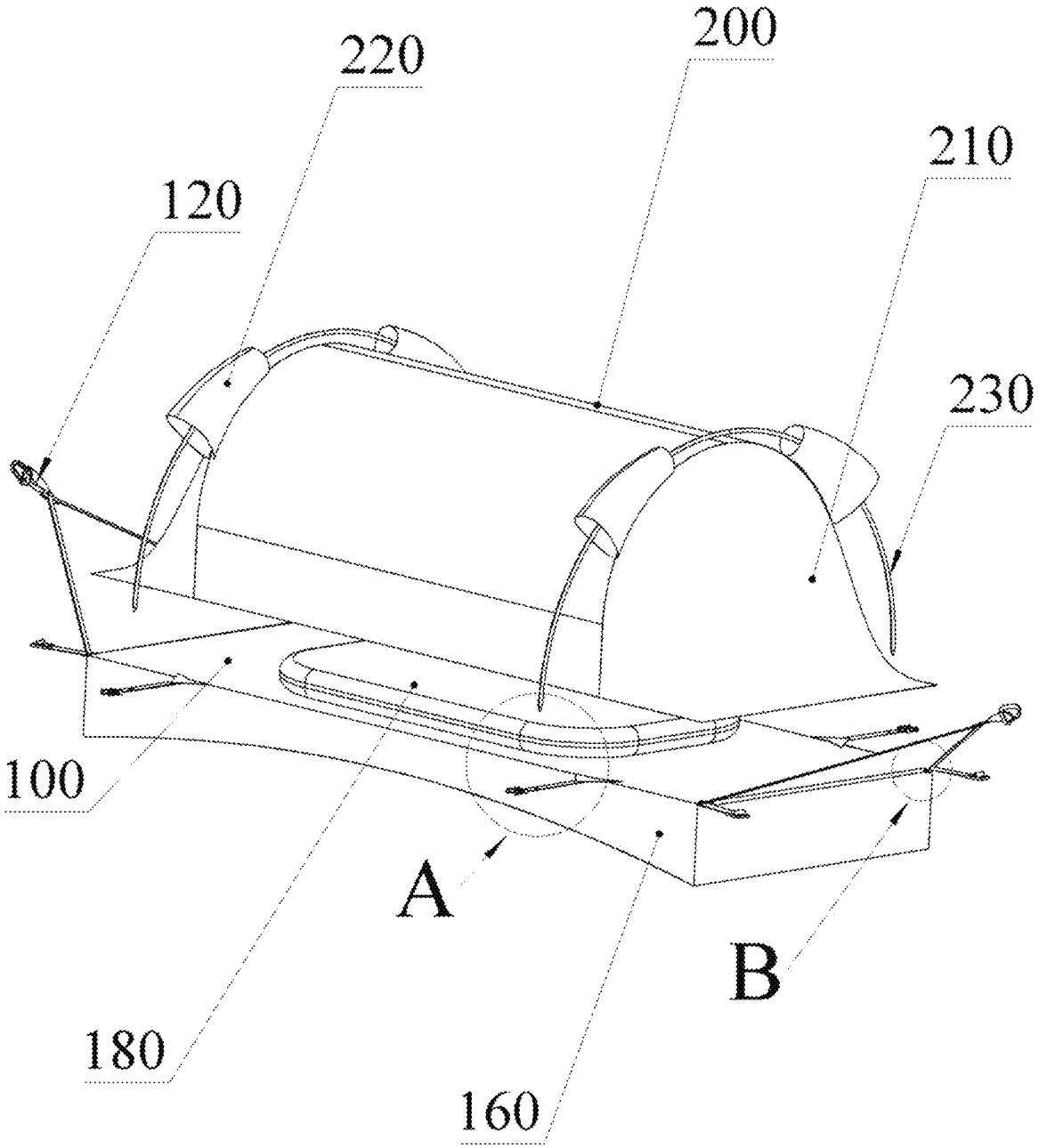
FIG. 2 is an exploded schematic view of the hammock body and insect-proof net in the embodiment of FIG. 1.

In this embodiment, referring to FIGS. 1 and 2, the hammock body 100 is equipped with an insect-proof net 200 and a fixing part 210 above it. The insect-proof net 200 is detachably attached to the hammock body 100, with both ends fixed to the fixing part 210 via stitching.

The insect-proof net 200 is made of flexible material with a mesh-like body, allowing breathability while protecting the user from mosquitoes or small pests.

Specifically, one end of the insect-proof net 200 overlaps with one end of the fixing part 210, secured by stitching. In this embodiment, the stitching is done by machine, while in other embodiments, it may be hand-stitched. Here, the connection method is stitching. In some embodiments, the connection can also be integrally formed, use hook-and-loop fasteners, adhesive bonding, or any other preferred method.

In this embodiment, two symmetrically distributed supporting parts 220 are arranged at both peripheral ends of the insect-proof net 200. The supporting parts 220 are made of the same material as the insect-proof net 200 and are fixedly connected to it.

Here, the supporting part 220 and the insect-proof net 200 are fixedly connected through stitching. In this embodiment, the stitching method is machine stitching, while in some embodiments, it can also be manual stitching. In some embodiments, the connection method can also be set as integral molding, hook-and-loop fasteners, adhesive bonding, or any other desired connection method.

In other embodiments (not shown), the supporting part can be arranged on the inner periphery of the insect-proof net. In this embodiment, the supporting part 220 is set as two groups, while in other embodiments (not shown), it can be set as one group, three groups, four groups, or any other desired number of groups. In other embodiments (not shown), the supporting part is not limited to the same material as the insect-proof net and can also be made of sturdy flexible materials or any other desired material.

In other embodiments, referring to FIGS. 1 and 2, two supporting parts 220 are internally inserted with arc-shaped rods 230, which encircle the insect-proof net 200 and are located on its outer surface.

Figure 3:
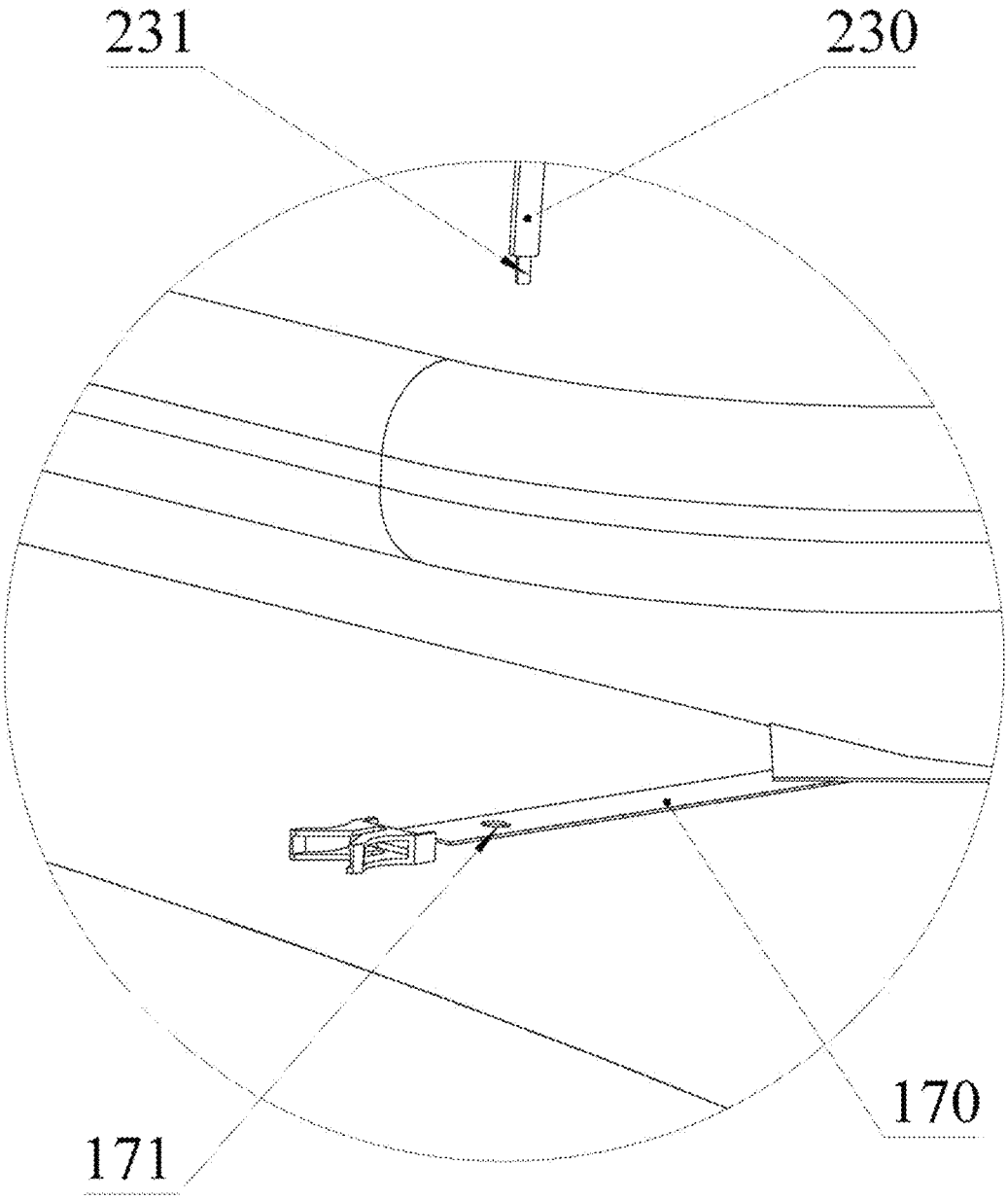
FIG. 3 is an enlarged schematic view of section A in the embodiment shown in FIG. 2.

Referring to FIGS. 1, 2, and 3, both ends of the arc-shaped rod 230 are equipped with fixing heads 231, while at least one corresponding mounting part 170 is arranged on each side of the hammock body 100. The mounting part 170 is provided with a fixing hole 171 no smaller than the fixing head 231. The arc-shaped rod 230 is detachably attached to the hammock body 100 and the insect-proof net 200 through the supporting part 220 and the fixing hole 171.

In this embodiment, the arc-shaped rod 230 is set as two rods. In other embodiments (not shown), the elastic rod is not limited to two and can also be set as one, three, four, or any other desired number of rods.

In this embodiment, the fixing head 231 is designed as a cylindrical structure with thick ends and a thin middle, which facilitates the alignment of the fixing hole 171 with the fixing head 231. In other embodiments (not shown), the fixing head is not limited to a cylindrical shape and can also be square, circular, elliptical, or any other desired geometric shape.

In this embodiment, referring to FIGS. 2 and 5, an air cushion 180 is placed inside the insect-proof net 200 and on the hammock body 100. Its inflatable structure provides even support, effectively eliminating the traditional hammock's lumbar suspension issue and elevating the lying experience to near-mattress comfort. Meanwhile, the air cushion's insulating air layer significantly enhances thermal insulation and moisture resistance. Its moderate rigidity, when combined with the anti-rollover system, further improves overall stability, ultimately achieving a harmonious integration of comfort, functionality, and safety.

In summary, as can be seen from the above description, the present disclosure achieves the following technical effects: A pouch-style extension part 160 is provided below the hammock body 100. When the user lies down, their body weight is supported by this extension part 160, effectively confining and stabilizing the center of gravity at the hammock's center, thereby fundamentally eliminating the risk of tipping over. Meanwhile, support rods are added at key stress points to distribute force, and an optional air cushion enhances comfort and insulation. Ultimately, this results in a hammock that is safe, stable, comfortable, durable, and suitable for a wider range of usage scenarios.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. An anti-rollover hammock, comprising:

a hammock body for supporting a user;

a suspension structure mounted at two ends of the hammock body and configured to be connected with an external support object; and a center-of-gravity stabilizing structure connected to the hammock body and collectively forming a stable area capable of accommodating at least part of the user's body, wherein the center-of-gravity stabilizing structure is an extension part disposed below the hammock body, with an edge thereof extending upward and connecting to a side edge of the hammock body, collectively forming an upward pocket-shaped supporting structure;

wherein when a user lies on the hammock body a load bearing of the user shifts from the hammock body to the extension part and the user's center of gravity is confined and stabilized within the pocket-shaped supporting structure to prevent the hammock from tipping over and wherein the center-of-gravity stabilizing structure is constructed to guide and constrain center-of-gravity shifts caused by rolling or posture changes when a force is applied by the user, keeping a center of gravity of the user within a stable range of a main structure to reduce or prevent lateral rollover of the hammock in a suspended state.

2. The anti-rollover hammock according to claim 1, wherein a bottom of the extension part has a transverse arc-shaped structure.

3. The anti-rollover hammock according to claim 1, wherein a connecting tube is arranged at a joint between the suspension structure and the hammock body, and a support rod is inserted into the connecting tube.

4. The anti-rollover hammock according to claim 3, wherein the support rod is a combinable rod, comprising at least two rod bodies connected by an elastic element.

5. The anti-rollover hammock according to claim 1, wherein an insect-proof net is detachably arranged above the hammock body.

6. The anti-rollover hammock according to claim 5, wherein the insect-proof net is maintained in an expanded state by at least one set of supporting parts and an arc-shaped rod inserted therein, with both ends of the arc-shaped rod detachably connected to mounting parts on two sides of the hammock body.

7. The anti-rollover hammock according to claim 1, wherein an air cushion is arranged on the hammock body.

8. The anti-rollover hammock according to claim 1, wherein a transverse width of the suspension structure decreases in a direction away from the hammock body, and the suspension structure has a triangular cross-section.

9. The anti-rollover hammock according to claim 1, wherein the suspension structure comprises a central connecting buckle and adjusting buckles located on both sides therebelow, and the central connecting buckle and the adjusting buckles are respectively configured to be connected to fixing points at different heights to form a triangular suspension structure.

10. The anti-rollover hammock according to claim 1, wherein the extension part is convex towards the hammock body in an unloaded state of the hammock.

11. An anti-rollover hammock, comprising:

a hammock body for supporting a user;

a suspension structure mounted at two ends of the hammock body and configured to be connected with an external support object; and an extension part connected to the hammock body, with an edge thereof extending upward and connecting to a side edge of the hammock body, collectively forming an upward pocket-shaped supporting structure, wherein a bottom of the extension part has a transverse arc-shaped structure;

wherein when a user lies on the hammock body a load bearing of the user shifts from the hammock body to the extension part and the user's center of gravity is confined and stabilized within the pocket-shaped supporting structure to prevent the hammock from tipping over and wherein when the user lies down, the pocket-shaped supporting structure is constructed to support the user's body and confine center-of-gravity shifts caused by body movements within a space formed by the pocket-shaped supporting structure to prevent the hammock from rolling over.

12. The anti-rollover hammock according to claim 11, wherein the extension part and the hammock body are connected by sewing, integral molding, hook-and-loop fasteners, adhesion, or snap-fit.

13. The anti-rollover hammock according to claim 11, wherein the suspension structure is a connecting part, a transverse width of the connecting part decreases in a direction away from the hammock body, and the connecting part has a triangular cross-section.

14. The anti-rollover hammock according to claim 13, wherein a connecting tube is provided at a joint between the connecting part and the hammock body, and a support rod is inserted into the connecting tube.

15. The anti-rollover hammock according to claim 14, wherein the support rod is a combinable rod, comprising at least two rod bodies connected by an elastic element.

16. The anti-rollover hammock according to claim 14, comprising adjusting buckles located on both sides below the connecting part at the two ends of the hammock body, and a connecting cap is provided on a side of an adjusting buckle of the adjusting buckles facing the connecting tube, with the connecting cap sleeved over an end of the support rod.

17. The anti-rollover hammock according to claim 16, wherein the connecting part further comprises a connecting buckle located above the adjusting buckles.

18. The anti-rollover hammock according to claim 17, wherein the connecting buckle is configured to be connected with a first fixing point on the external support object, and the adjusting buckles are configured to be connected with second fixing points on the external support object that are lower than the first fixing point, thereby forming a stable and non-sagging bed surface when the hammock body is suspended.

19. The anti-rollover hammock according to claim 11, wherein an insect-proof net is detachably arranged above the hammock body, and the insect-proof net is maintained in an expanded state by at least one set of supporting parts and arc-shaped rods inserted therein, with both ends of the arc-shaped rods detachably connected to mounting parts arranged on both sides of the hammock body.

20. The anti-rollover hammock according to claim 11, wherein the extension part is convex towards the hammock body in an unloaded state of the hammock.

* * * * *